US009090314B2

(12) United States Patent
Ulgen

(10) Patent No.: US 9,090,314 B2
(45) Date of Patent: Jul. 28, 2015

(54) MODULAR UNDERWATER FOIL FOR A MARINE VESSEL

(71) Applicant: Mehmet Nevres Ulgen, Istanbul (TR)

(72) Inventor: Mehmet Nevres Ulgen, Istanbul (TR)

( * ) Notice: Subject to any disclaimer, the term of this patent is extended or adjusted under 35 U.S.C. 154(b) by 0 days.

(21) Appl. No.: 14/221,756

(22) Filed: Mar. 21, 2014

(65) Prior Publication Data

US 2014/0366794 A1 Dec. 18, 2014

(30) Foreign Application Priority Data

Jun. 14, 2013 (TR) ..... 2013 07189

(51) Int. Cl.
*B63B 1/24* (2006.01)
*B63B 1/28* (2006.01)

(52) U.S. Cl.
CPC .. *B63B 1/248* (2013.01); *B63B 1/28* (2013.01)

(58) Field of Classification Search
CPC ..... B63B 1/248; B63B 1/24
USPC ..... 114/274, 280, 285
See application file for complete search history.

(56) References Cited

U.S. PATENT DOCUMENTS

| | | | | | |
|---|---|---|---|---|---|
| 2,719,503 | A | * | 10/1955 | Smith | 415/8 |
| 3,996,872 | A | * | 12/1976 | Pinchot, III | 114/280 |
| 4,080,922 | A | * | 3/1978 | Brubaker | 114/282 |
| 4,862,820 | A | * | 9/1989 | Guezou et al. | 114/278 |
| 4,915,048 | A | * | 4/1990 | Stanford | 114/274 |
| 4,947,775 | A | * | 8/1990 | Bamford | 114/39.24 |
| 5,231,950 | A | * | 8/1993 | Poulos | 114/274 |
| 5,448,963 | A | * | 9/1995 | Gallington | 114/274 |
| 5,493,990 | A | * | 2/1996 | Dyer | 114/145 A |
| 5,653,189 | A | * | 8/1997 | Payne | 114/274 |
| 6,220,195 | B1 | * | 4/2001 | Crews | 114/145 A |
| 6,227,139 | B1 | * | 5/2001 | Nguyen et al. | 114/332 |
| 6,397,772 | B1 | * | 6/2002 | Christensen | 114/145 A |
| 8,312,831 | B2 | * | 11/2012 | Templeman et al. | 114/274 |
| 8,534,211 | B2 | * | 9/2013 | Venables et al. | 114/126 |
| 2013/0167761 | A1 | | 7/2013 | Cosic | |
| 2013/0167766 | A1 | * | 7/2013 | Ulgen | 114/280 |

* cited by examiner

*Primary Examiner* — Lars A Olson
*Assistant Examiner* — Jovon Hayes
(74) *Attorney, Agent, or Firm* — Vidas, Arrett & Steinkraus, P.A.

(57) ABSTRACT

The present invention relates to an underwater foil (1) for a marine vessel of the type floating on water disposed completely below the waterline and extending in the port-starboard direction. The underwater foil (1) comprises a plurality of foil members (2, 3) connected to each other in order to form the underwater foil (1).

14 Claims, 7 Drawing Sheets

MODULAR UNDERWATER FOIL FOR A MARINE VESSEL

CROSS-REFERENCE TO RELATED APPLICATIONS

This application claims priority to TR 2013/07189, filed on Jun. 14, 2013

STATEMENT REGARDING FEDERALLY SPONSORED RESEARCH

Not applicable.

BACKGROUND OF THE INVENTION

The present invention relates to a modular underwater foil for a marine vessel of the type floating on water disposed completely below the waterline and extending in the port-starboard direction.

The engine power required for providing thrust to the marine vessel should be greater as the weight and resistance resulting from contact of the hull with water of the marine vessels is greater, which increases fuel consumption.

Hydrofoils are known to be used in order to reduce the resistance between the boat hull and water. Hydrofoils are often mounted at the bottom of marine vessel hull and typically on bow and stern. In such a case, the angle of attack of the hydrofoil cannot be changed dynamically by the user. Therefore, achieving a comfortable cruise by reducing the resistance between the marine vessel and water is not possible in relatively rough and stationary water conditions. Further to that, hydrofoils cannot function in very rough waters.

On the other hand, using foils below the hull of the marine vessel for reducing water resistance of the marine vessels of the type floating on water is known from the prior art. In fact, an underwater foil is disclosed in US Patent Publication No. 20130167766 filed by the patent owner of the present invention, the disclosure of which is incorporated herein by reference. In said application, the angle of attack of the underwater foil has a dynamically changeable function and propellers are supported by the underwater foil.

An underwater foil can be produced in various lengths depending on the characteristics such as tonnage, speed and size of the marine vessel. For example, the underwater foil can be integrally produced in the form of a welded plate; in this case however, separate molds are needed for each foil of different length, which is costly. On the other hand, as the length of the foil increases, welding quality and strength decrease depending on the material and obtaining ideal foil profiles may not be achieved. In addition, delivery of the integral underwater foil from the production site to the assembly site is challenging.

Aforementioned drawbacks are avoided if an underwater foil can be produced in a modular manner.

BRIEF SUMMARY OF THE INVENTION

An object of the present invention is to provide an underwater foil that can be effectively adapted according to the tonnage characteristics of a marine vessel of the type floating on water in order to provide a lightweight boat behavior and a low driving power.

The above object can be reached by an underwater foil for a floating marine vessel extending along the port-starboard direction of the marine vessel, wherein the underwater foil comprises a plurality of upper foil members and lower foil members engaged to the upper foil members, wherein each upper foil member is aligned offset to the respective lower foil members to form an underwater foil. Thus, length of the foil can be easily adapted according to the characteristics of the marine vessel by means of modular foil members.

In an embodiment of the present invention, upper foil members and lower foil members are first attached to one another other by means of protrusions and recesses extending along the longitudinal direction thereof and then rigidly secured by means of a securing element.

The underwater foil according to the present invention comprises a central lower foil member disposed in the middle of lower foil members and a plurality of lateral lower foil members incorporated to the right and left side thereof A connection slot is disposed on the central lower foil member for the connection of a piston driving the foil, which enables the underwater foil to tilt as desired. In addition, the upper foil members and lower foil members comprise slots bearing the shaft around which the foil rotates for tilting the foil.

BRIEF DESCRIPTION OF THE SEVERAL VIEWS OF THE DRAWINGS

Embodiment of the present invention and advantages thereof with the additional components should be considered together with the figures explained below in order to be fully understood.

DETAILED DESCRIPTION OF THE INVENTION

While this invention may be embodied in many different forms, there are described in detail herein a specific preferred embodiment of the invention. This description is an exemplification of the principles of the invention and is not intended to limit the invention to the particular embodiment illustrated.

Figure 1:
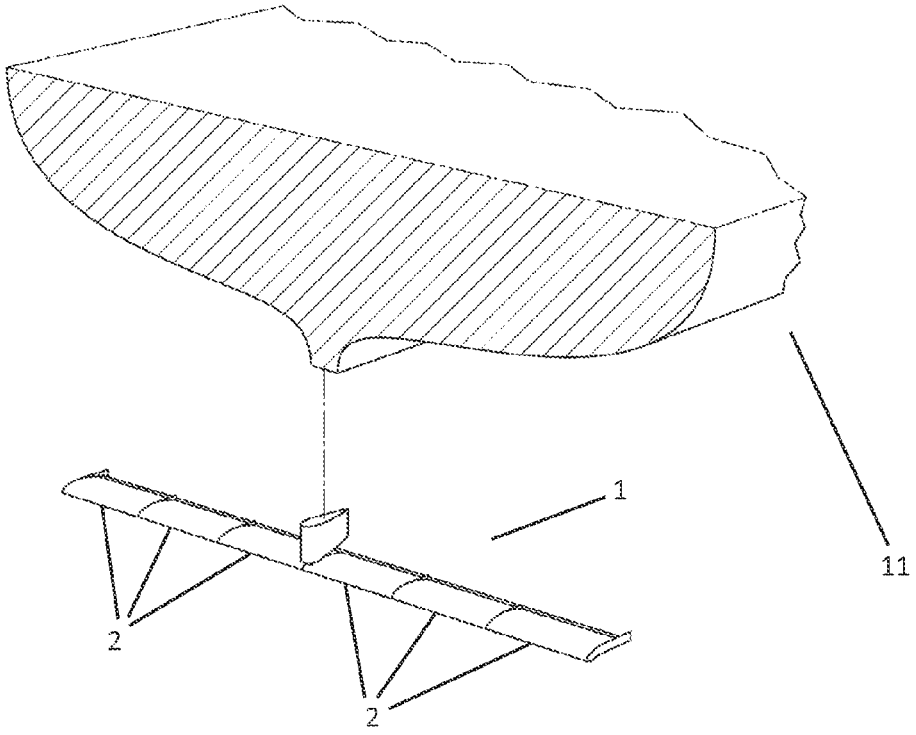
FIG. 1 is a perspective top view of the underwater foil according to the present invention.

As shown in FIG. 1, the underwater foil (1) according to the present invention comprises a plurality of upper foil members (2) arranged side by side and a plurality of lower foil members (3) arranged side by side as well. The upper foil members (2) are engaged and secured to the lower foil members (3).

The upper foil members (2) generally comprise a rectangular form. Front ends (2.1) of the upper foil members serving as a leading edge comprise an arcuate form. Similarly, outer surfaces (2.3) of the upper foil members (2) also comprise an arcuate form. The arcuation on the front end (2.1) as well as outer surface (2.3) of the upper edge pieces (2) is around the arcuation levels of a NACA (National Advisory Committee for Aeronautics) foil profile known in the art.

Inner surfaces (2.4) of the upper foil members (2) are generally hollow and walls (2.5) extending perpendicularly to the inner surface (2.4) of the upper foil members (2) are provided. Shaft slots (2.6) are formed at the upper foil walls (2.5) towards the foil front end (2.1) and in the longitudinal direction of the foil. A shaft (6), to be described later, is supported at these slots (2.6).

Upper foil members (2) comprise upper foil connection recesses (2.7) extending in the longitudinal direction of the foil so as to remain on the inner surfaces (2.4) of the upper foil members (2) and to remain up to a certain extent at a rear side from the front end (2.1) of the upper foil members (2). Said upper foil connection recesses (2.7) extend along the longitudinal direction of each upper foil member (2) in a channel like manner. Cross section of the upper foil connection recesses (2.7) is in the form of a sideways tilted "U", wherein said cross section can also comprise a "dovetail" form or an arcuate form such as a semi elliptical form.

Upper surfaces of the upper foil walls (2.5) and surfaces remaining below the upper foil connection recess (2.7) define a lower foil member seating surface (2.11). An upper foil connection protrusion (2.10) extending perpendicularly from the lower foil member seating surface (2.11) and along the foil axis is formed on the rear end (2.2) of the upper foil members (2). The upper foil connection protrusion (2.10), to be described later, comprises a lower foil connection recess (3.10). A plurality of upper foil connection holes (2.9) are formed along the width of the upper foil connection protrusions (2.10).

Cross section of the upper foil connection protrusions (2.10) is in the form of an inverted "U", wherein said cross section can also comprise a "dovetail" form or an arcuate form such as a semi elliptical form.

The lower foil members (3) engaged to the upper foil members (2) comprise a substantially rectangular form. Rear ends (3.2) of the lower foil members serving as a trailing edge comprise a gradually tapering form. Outer surfaces (3.3) of the lower foil members (3) comprise an arcuate (convex) form. The arcuation of the outer surface of the lower edge pieces (3) is around the arcuation levels of a NACA foil profile known in the art.

Inner surfaces (3.4) of the lower foil members (3) are generally depressed and walls (3.5) extend perpendicularly from the inner surface (3.4) of the lower foil members (3). Shaft slots (3.6) are formed at the lower foil walls (3.5) towards the foil front end (3.1) and in the longitudinal direction of the foil. Shaft (6), to be described later, is supported at these slots (3.6).

Lower foil members (3) comprise lower foil connection protrusions (3.7) extending in the longitudinal direction of the foil so as to remain on the inner surfaces (3.4) of the lower foil members (3) and to remain up to a certain extent at the front portion from the front end (3.1) of the upper foil members (3). Cross section of the lower foil connection protrusions (3.7) is in the form of a sideways tilted "U" in accordance with the form of the upper foil connection recesses (2.7), wherein said cross section can also comprise a "dovetail" form or an arcuate form such as a semi elliptical form.

Upper surfaces of the lower foil walls (3.5) define an upper foil member seating surface (3.11). Lower foil connection recess (3.10) extending from the lower foil member seating surface (2.11) and along the foil axis is formed on the rear end (3.2) portion of the lower foil members (3). Upper foil connection protrusion (2.10) described above is placed into the lower foil connection recess (3.10). A plurality of lower foil connection holes (3.9) are formed along the width of the lower foil connection recesses (3.10).

Cross section of the lower foil connection recesses (3.10) is in the form of a "U" in accordance with the form of the upper foil connection protrusions (2.10), wherein said cross section can also comprise a "dovetail" form or an arcuate form such as a semi elliptical form.

Figure 2:
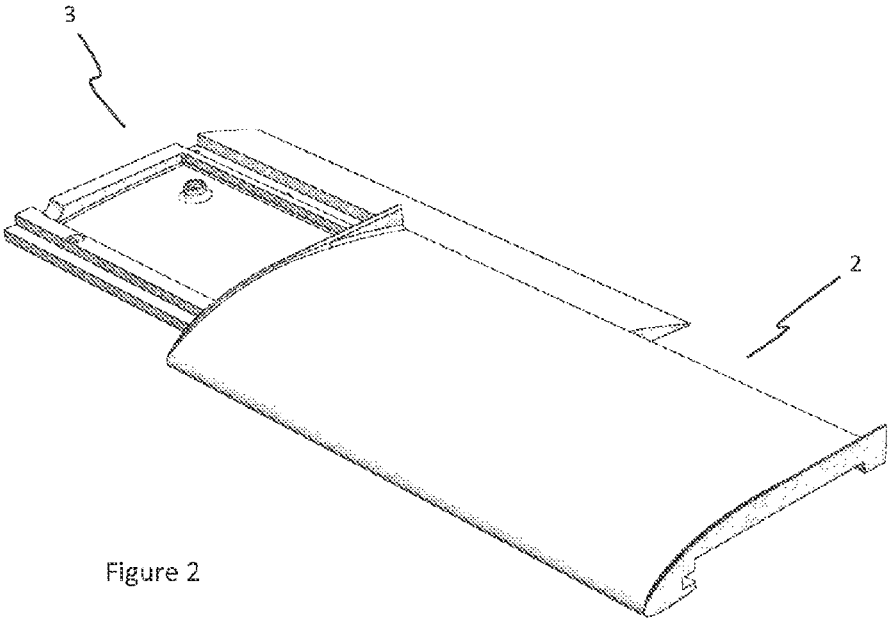
FIG. 2 is a perspective view of the upper foil member and lower foil member attached to each other.
Figure 15:
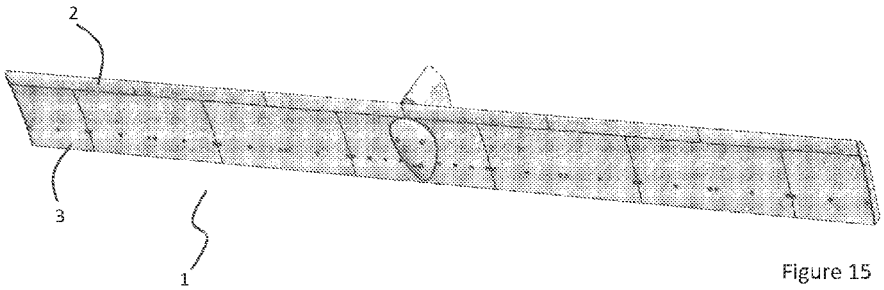
FIG. 15 is a perspective bottom view of the underwater foil according to the present invention.
Figure 16:
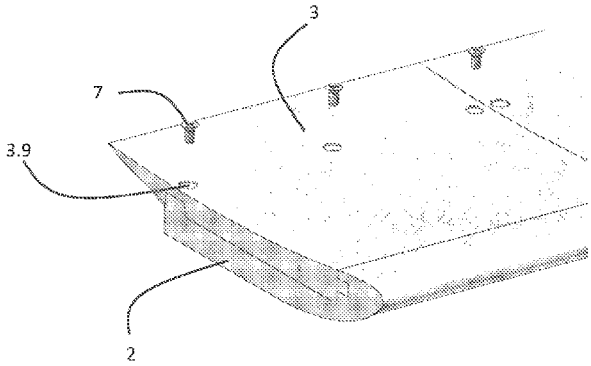
FIG. 16 is a partial perspective bottom view of the upper and lower foil members attached to each other prior to the bolting.
Figure 17:
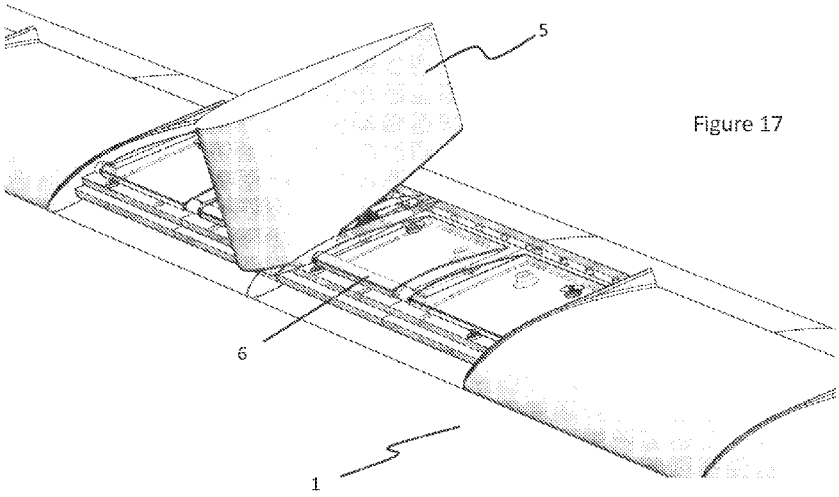
FIG. 17 is a partial perspective top view of the foil-hull connection piece and central lower foil member of the underwater foil according to the present invention.
Figure 18:
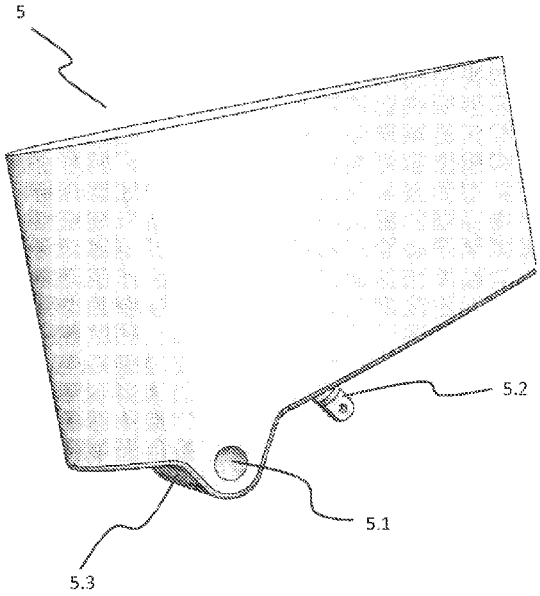
FIG. 18 is a perspective view of the foil-hull connection piece.

Underwater foil shown in FIGS. 1 and 15 is formed when upper foil members (2) and lower foil members (3) are secured to each other. To achieve this, as shown in FIG. 2, the connection protrusion (3.7) of a lower foil member (3) is inserted into the respective upper foil connection recess (2.7) by sliding thereof axially. In the meantime, the upper foil connection protrusion (2.10) is slid into the lower foil connection recess (3.10). Sliding the lower foil member (3) is terminated approximately halfway through the length of the upper foil member (2). Another lower foil member (3) is likewise inserted by sliding through the other end of the upper foil member (2). Subsequently attached lower foil member is slid until abutting the initially attached lower foil member. Other upper foil members (2) and lower foil members (3) are engaged to one another in a likewise fashion. Therefore, upper foil members (2) and lower foil members are engaged in an offset manner to each other.

Positions of the upper foil connection recess (2.7) and lower foil connection protrusion (3.7) can be changed. Namely, the protrusion form (3.7) of the lower foil member can be arranged on the upper foil member (2) and the recess form (2.7) of the upper foil member can be arranged on the lower foil member (3). According to an embodiment of the present invention, in both cases, a connection element such as a bolt is not needed for the engagement of protrusions and recesses (3.7, 2.7). This can be a result of an offset engagement of the upper foil members (2) and lower foil members (3). Alternatively, a connection element can be optionally used for the engagement of protrusions and recesses (3.7, 2.7).

Similarly, positions of the upper foil connection protrusion (2.10) and lower foil connection recess (3.10) can be changed. Namely, the recess form (3.10) of the lower foil member can be arranged on the upper foil member (2) and the protrusion form (2.10) of the upper foil member can be arranged on the lower foil member (3).

Figure 3:
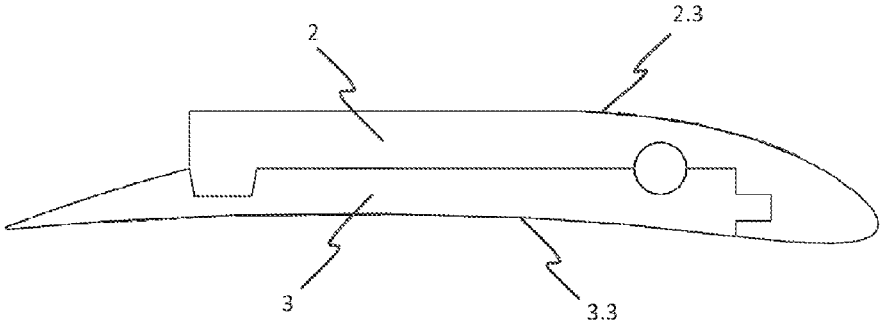
FIG. 3 is a cross sectional side view of the underwater foil according to the present invention.
Figure 4:
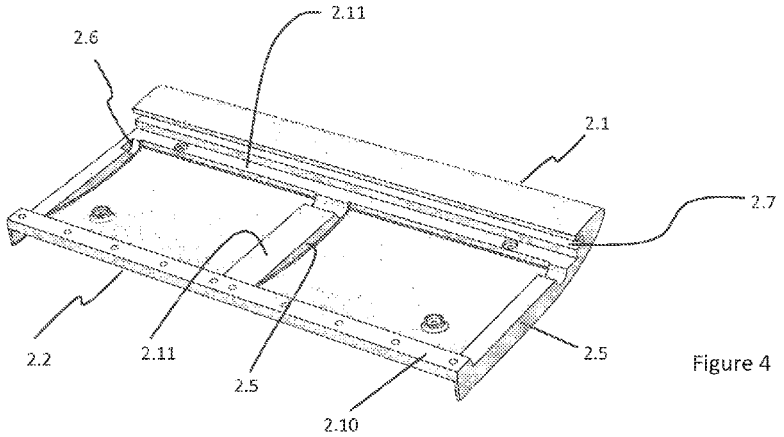
FIG. 4 is a perspective bottom view of the upper foil member remaining in the end portion.
Figure 5:
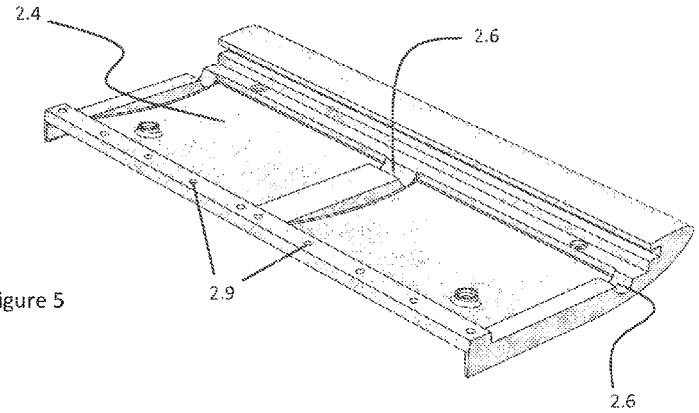
FIG. 5 is a perspective bottom view of the upper foil member remaining in the middle portion.
Figure 6:
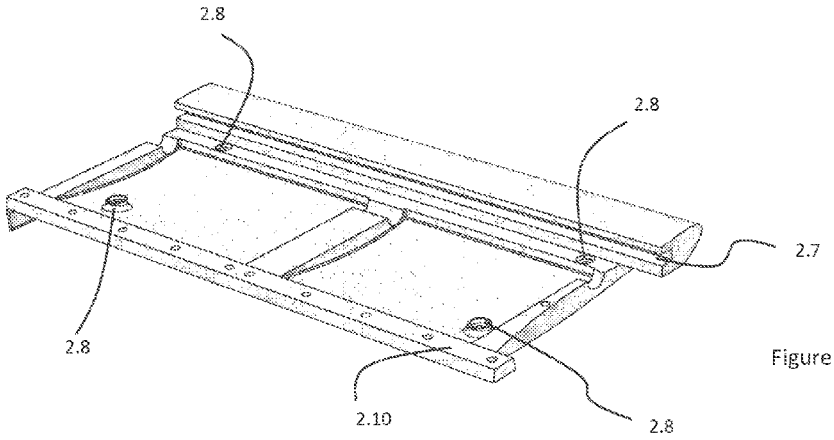
FIG. 6 is a perspective bottom view of another upper foil member remaining in the middle portion.
Figure 7:
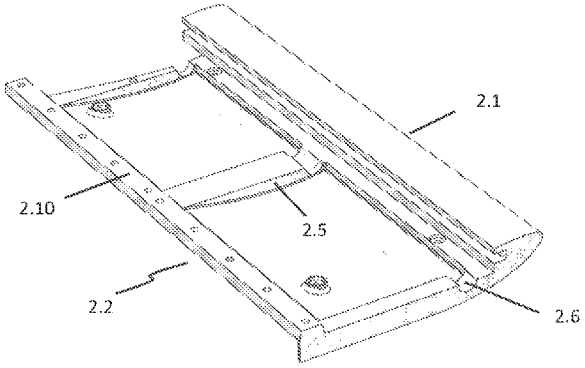
FIG. 7 is a perspective bottom view of another upper foil member remaining in the middle portion.
Figure 8:
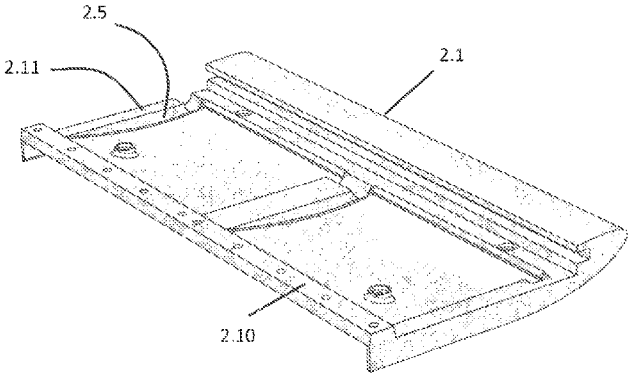
FIG. 8 is a perspective bottom view of another upper foil member remaining in the end portion.
Figure 9:
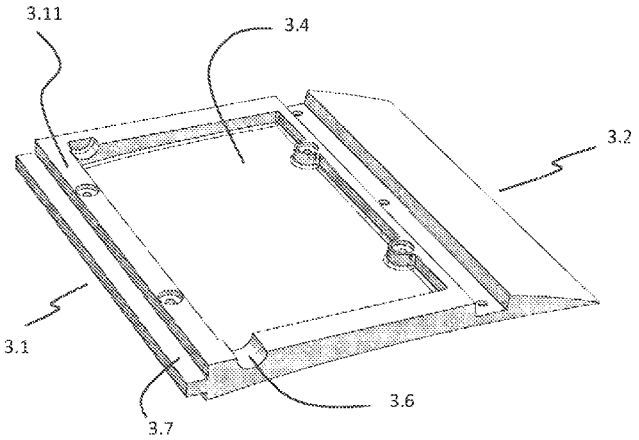
FIG. 9 is a perspective top view of the lower foil member remaining in the end portion.
Figure 10:
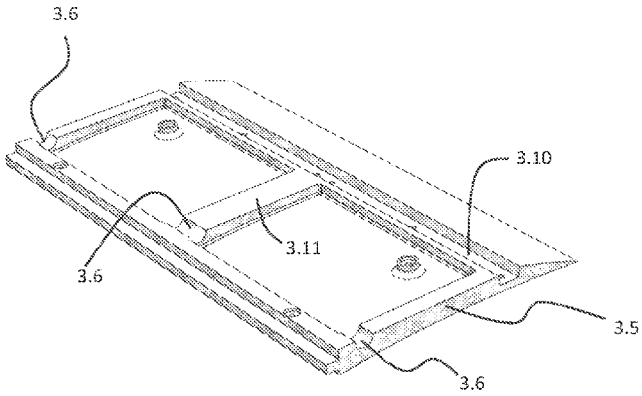
FIG. 10 is a perspective top view of the lower foil member remaining in the middle portion.
Figure 11:
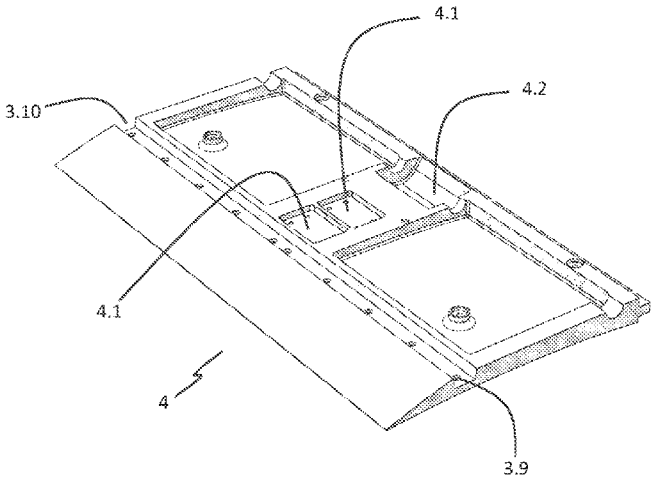
FIG. 11 is a perspective top view of the central lower foil member.
Figure 12:
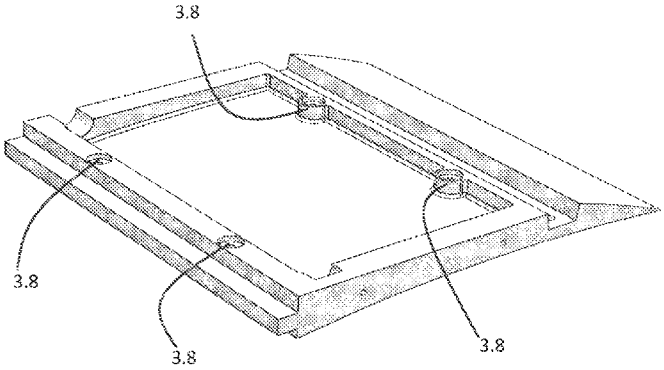
FIG. 12 is a perspective top view of the lower foil member remaining in the end portion.
Figure 13:
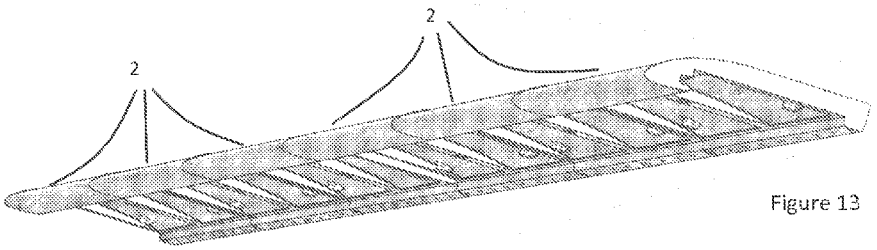
FIG. 13 is a perspective bottom view of the upper foil members arranged side by side.
Figure 14:
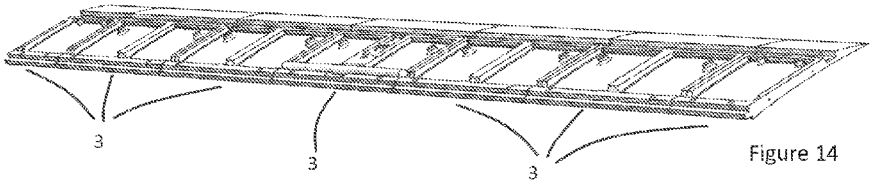
FIG. 14 is a perspective top view of the lower foil members arranged side by side.

Clearance of the upper foil connection holes (2.9) and lower foil connection holes (3.9) are arranged such that said holes (2.9, 3.9) overlap when upper foil members (2) and lower foil members (3) are attached together. Then, a bolt (7) is passed through said holes (2.9, 3.9) and secured. In this case, lower foil member seating surfaces (2.11) and upper foil member seating surfaces (3.11) abut one another. Thus, upper foil members (2) and lower foil members (3) are rigidly secured to each other and a NACA profile cross section foil as shown in FIG. 3 is obtained.

As disclosed in U.S. Ser. No. 13/341,446, underwater foil (1) can be tilted by means of a piston (5.2) (by changing the angle of attack thereof) and ascending or descending of the marine vessel according to the water level can be achieved. Piston (5.2), at a piston connection slot (4.1) formed on the inner surface of a central lower foil member (4), is connected to said central lower foil member (4). According to a preferred embodiment of the present invention, central lower foil member (4) comprises at least one and preferably two piston connection slots (4.1) arranged successively in the direction transverse to said foil member (4). Piston (5.2) can be attached to anyone of the desired piston connection slots (4.2) depending on the characteristics of the marine vessel to be provided with the underwater foil (1) or depending on the performance desired to be obtained with the underwater foil.

Underwater foil (1) is coupled to the marine vessel 11 by means of a foil-hull connection piece (5). An arcuate foil-hull connection end (5.3) extending downwardly is arranged at the front lower portion of the foil-hull connection piece (5). A shaft receiving hole (5.1) is formed along the width of the foil-hull connection end (5.3) (i.e. in the longitudinal direction of the underwater foil). In case of mounting, curved foil-hull connection end (5.3) is surrounded by the foil-hull connection slot (4.2) arranged on the front edge of the central lower foil member (4) having an arcuate form. Thus, a potential contact of the arcuate foil-hull connection end (5.3) is prevented when the underwater foil (1) is tilted.

In case of mounting, a shaft (6) supported by the shaft slot (2.6) of the upper foil and shaft slot (3.6) of the lower foil and extending along the longitudinal direction of the underwater foil is passed through the shaft receiving hole (5.1) of the foil-hull connection end (5.3). Shaft (6) is rotatably connected inside the shaft receiving hole (5.1). Thus, by means of the piston (5.2) drive, relative rotation of the underwater foil (1) according to the foil-hull connection piece (5) becomes possible. Shaft (6), as mentioned above, is also supported along the longitudinal direction of the underwater foil by means of each upper foil member (2) and lower foil member (3) and similarly, shaft (6) is rotatably supported inside the upper foil shaft slot (2.6) and lower foil shaft slot (3.6).

Upper and lower foil members (2, 3), according to the intended purpose thereof, can be produced in different ways from any suitable material such as aluminum, steel, etc. For example, production can be carried out by machining (for example, by milling) solid materials. In such a case, utilization of some apparatus may be required to secure the foil members (2, 3) on the machining lathe. Securing slots (2.8, 3.8) shown in FIGS. 4 to 14 on the lower and upper foil members are arranged for such a purpose.

This completes the description of the preferred and alternate embodiments of the invention. Those skilled in the art may recognize other equivalents to the specific embodiment described herein which equivalents are intended to be encompassed by the claims attached hereto.

What is claimed is:

1. An underwater foil for a floating marine vessel, extending along the port-starboard direction of the marine vessel, wherein the underwater foil comprises a plurality of generally rectangular upper foil members and generally rectangular lower foil members engaged together to form the underwater foil, said lower foil members including a central lower foil member between lower foil members, said central foil member including a connection to a foil-to-hull connection member for connection to a marine vessel, wherein each upper foil member is aligned offset to the respective lower foil members such that the length of the foil may be formed in the length desired from upper and lower foil members.

2. An underwater foil according to claim 1, wherein the upper foil members include upper foil connection recesses disposed proximate to the front end thereof and extending in the longitudinal direction of the underwater foil; and the lower foil members include lower foil connection protrusions disposed proximate to the front end thereof and extending in the longitudinal direction of the underwater foil.

3. An underwater foil according to claim 1, wherein the upper foil members include upper foil connection protrusions disposed proximate to the front end thereof and extending in the longitudinal direction of the underwater foil; and the lower foil members include lower foil connection recesses disposed proximate to the front end thereof and extending in the longitudinal direction of the underwater foil.

4. An underwater foil according to claim 1, wherein the upper foil members include upper foil connection protrusions disposed proximate to the rear end thereof and extending in the longitudinal direction of the underwater foil; and lower foil members include lower foil connection recesses disposed proximate to the rear end thereof and extending in the longitudinal direction of the underwater foil.

5. An underwater foil according to claim 1, wherein the upper foil members include upper foil connection recesses disposed proximate to the rear end thereof and extending in the longitudinal direction of the underwater foil; and lower foil members (3) include lower foil connection protrusions toward the rear end (3.2) thereof and extending in the longitudinal direction of the underwater foil.

6. An underwater foil according to claim 4, further comprising a plurality of upper foil connection holes formed along the width of the upper foil connection protrusions through which a connection element is passed and a plurality of lower foil connection holes formed along the width of the lower foil connection recesses through which a connection element is passed.

7. An underwater foil according to claim 5, further comprising a plurality of upper foil connection holes formed along the width of the upper foil connection protrusions through which a connection element is passed and a plurality of lower foil connection holes formed along the width of the lower foil connection recesses through which a connection element is passed.

8. An underwater foil according to claim 1, further comprising walls extending perpendicularly to the inner surface of the upper foil members and walls extending perpendicularly to the inner surface of the lower foil members.

9. An underwater foil according to claim 8, further comprising shaft slots formed on the upper foil walls disposed proximate to the foil front end; and shaft slots formed on the lower foil walls disposed proximate to the foil front end.

10. An underwater foil according to claim 9, further comprising a shaft rotatably supported in the shaft slots.

11. An underwater foil according to claim 1, further comprising a central lower foil member disposed in the middle of the lower foil members and comprising two piston connection slots arranged successively in the transversal direction thereto.

12. An underwater foil according to claim 11, further comprising a foil-hull connection slot having an arcuate form, arranged on the front edge of the central lower foil member.

13. A modular, underwater foil for a floating marine vessel, extending along the port-starboard direction of the marine vessel, wherein the underwater foil comprises a plurality of generally rectangular upper foil members and generally rectangular lower foil members engaged together to form the underwater foil, said lower foil members including a central lower foil member between and connected to said lower foil members, said central foil member including a connection to a foil-to-hull connection member for connection to a marine vessel, said lower foil members including a lateral connection protrusion and said upper foil members including a lateral connection recess such that an upper foil member may be slidably engaged with a lower foil member via said protrusions and slots and slid until each upper foil member is aligned offset to the respective lower foil members such that connection joints between adjacent upper foil members are not aligned with connection joints of adjacent lower foil members such that the length of the foil may be formed in the length desired from upper and lower foil members.

14. The underwater foil of claim 13 wherein said foil-to-hull connection member is connected to said central lower foil member to a shaft mounted to said central lower foil member.

* * * * *